United States Patent [19]

Mattisson et al.

[11] 4,351,997

[45] Sep. 28, 1982

[54] FOOD PACKAGE

[75] Inventors: Lennart Mattisson, Kagenrod; Bertil Ganrot, Bjuv, both of Sweden

[73] Assignee: Societe d'Assistance Technique pour Produits Nestle S.A., Lausanne, Switzerland

[21] Appl. No.: 179,635

[22] Filed: Aug. 20, 1980

[30] Foreign Application Priority Data

Aug. 27, 1979 [SE] Sweden ..... 7907117

[51] Int. Cl.[3] ..... H05B 6/80

[52] U.S. Cl. ..... 219/10.55 E; 219/10.55 F; 426/107

[58] Field of Search ..... 219/10.55 E, 10.55 F, 219/10.55 R, 10.55 M; 426/107; 229/43, 30; 220/352, 82 R

[56] References Cited

U.S. PATENT DOCUMENTS

| | | | |
|---|---|---|---|
| 2,714,070 | 7/1955 | Welch | 219/10.55 E X |
| 3,941,967 | 3/1976 | Sumi et al. | 219/10.55 E |
| 3,974,354 | 8/1976 | Long | 219/10.55 E |
| 4,081,646 | 3/1978 | Goltsos | 219/10.55 E |
| 4,183,435 | 1/1980 | Thompson et al. | 219/10.55 E |
| 4,210,674 | 7/1980 | Mitchell | 219/10.55 E X |

*Primary Examiner*—Arthur T. Grimley

*Attorney, Agent, or Firm*—Vogt & O'Donnell

[57] ABSTRACT

The invention relates to a food package for controlled heating or cooking of prepared food in hot air, convection, household and microwave ovens.

The package comprises a tray (1) including a bottom wall (2) and an upwardly extending peripheral wall (3) which is outwardly curved at its upper end, defining a horizontally extending peripheral rim (4), said peripheral wall and rim being of or at least their inner surface being coated with a microwave radiation-reflecting or opaque material (5) and said bottom wall (2) being of a microwave radiation-transparent material or being easily removable.

7 Claims, 6 Drawing Figures

FOOD PACKAGE

Figure 1:
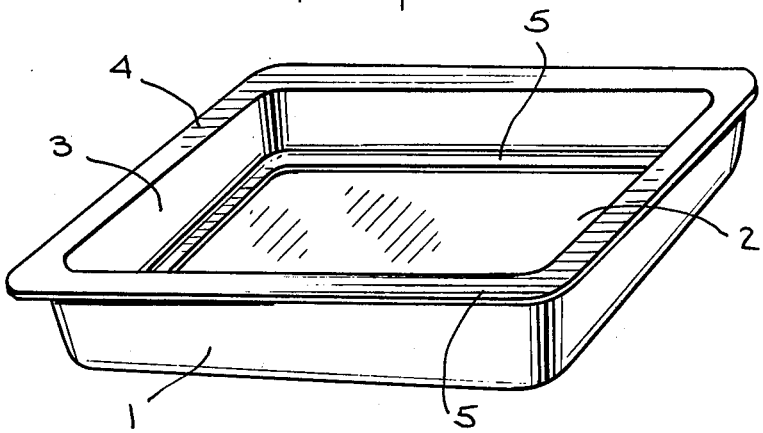

This invention relates to a food package for controlled heating or cooking of prepared food in hot air, convection, household and microwave ovens.

The rapid increase of the microwave oven sale to private households and the development of catering have changed the conditions for the prepared food manufacturers implying great advantages as well as problems. The advantages are evident and connected with the rapid heating in microwaves which make frozen prepared food even more convenient. There are two main problems:

The traditional metallic tray is opaque to microwave radiation and is not suitable in those microwave ovens, which have no protection for the magnetron, as arcing may occur inside the oven cavity which may damage the magnetron.

Owing to the limited penetration depth of microwaves, the cooking of some products may be fairly uneven, since metals are not transparent to microwaves and heating is obtained only from the top and downwards. Particularly for frozen products, this leads to an uneven cooking with a cold and also still frozen bottom layer while the top layer is overcooked and unacceptable (dry or burnt).

Most recent development work in the package industry in relation to microwave cooking has dealt with the problem of selective cooking of multicomponent meals in which the individual food components generally require different quantities of microwave energy exposure.

For example, U.S. Pat. No. 3,865,301 describes a shielded container for a plurality of ingredients of a sandwich-type food product that are to be heated or cooked to a different extent and which is opaque to microwave radiation except for radiation-transparent windows.

U.S. Pat. No. 4,081,646 illustrates a tray in a material transparent to microwave energy with a plurality of compartments, a cover formed of a material that is transparent to microwave radiation and adapted to the tray and a shielding box having walls opaque to microwave energy and bearing apertures at predetermined locations for inserting the tray with the cover therein, in order to control the amount of radiation received by each of the individual components of a meal.

In the prior developments very little attention has been paid to uneven cooking of a prepared dish within a single compartment or tray in a microwave oven. Aluminium trays are used without problems in household ovens but are not satisfactory for microwave ovens.

Trays of other materials (plastics, plastic coated paperboards, etc.) are also used and cooking e.g. in a paperboard tray generally gives a much more even cooking and a better qualitative result in a microwave oven.

However none of these seem to be satisfactory packages either, because the cooking is still uneven owing to the specific product shape and e.g. the polyester coated paperboard trays, cannot withstand top surface browning, which is important for many types of prepared food. Most modern microwave ovens are now equipped with grills for browning. Being exposed to grilling temperatures (over 200° C.) in household ovens or in microwave ovens with IR-grill, the board dehydrates and deteriorates, becoming brown and brittle.

For these reasons there is a problem, as the existing trays cannot be used in both microwave ovens and in household ovens.

A principal object of this invention is to provide a package in a tray form which is possible to use in hot air, convection and household ovens at temperatures up to 300° C. and also in all types of microwave ovens.

A further object of this invention is to provide a package in a tray form which gives an excellent temperature distribution and minimises the effects of arcing and charring.

The invention concerns a food package for controlled heating or cooking of prepared food in hot air, convection, household and microwave ovens, comprising a tray including a bottom wall and an upwardly extending peripheral wall which is outwardly curved at its upper end, defining a horizontally extending peripheral rim, said peripheral wall or at least the inner surface thereof or the upper part thereof forming the rim as well as the parts of the wall around its corners being of or coated with a microwave radiation-reflecting or opaque material and said bottom being in a microwave radiation-transparent material or being easily removable. The invention will be better understood from the following description considered in connection with the accompanying drawings which illustrate preferred embodiments thereof.

Figure 2:
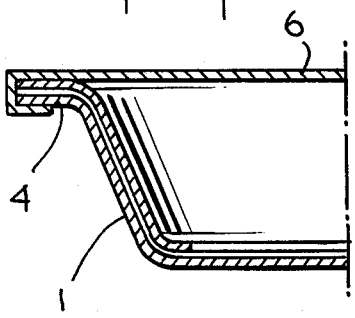

In the drawings:

FIG. 1 is a perspective view of a first embodiment of the package without lid on, FIG. 2 is a cross-sectional view of part of the embodiment of the package shown in FIG. 1 with a first lid.

Figure 3:
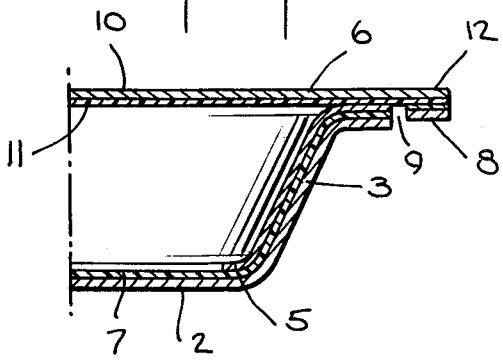
Figure 4:
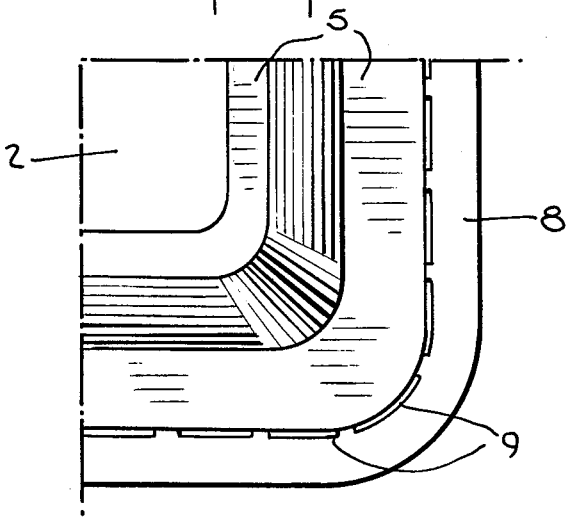
Figure 5:
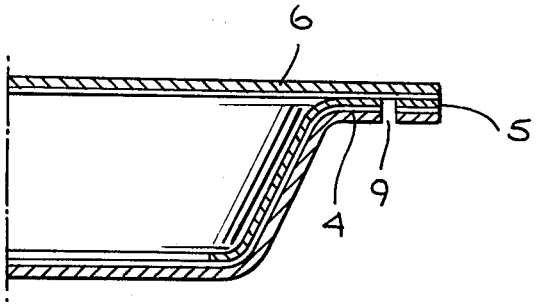
Figure 6:
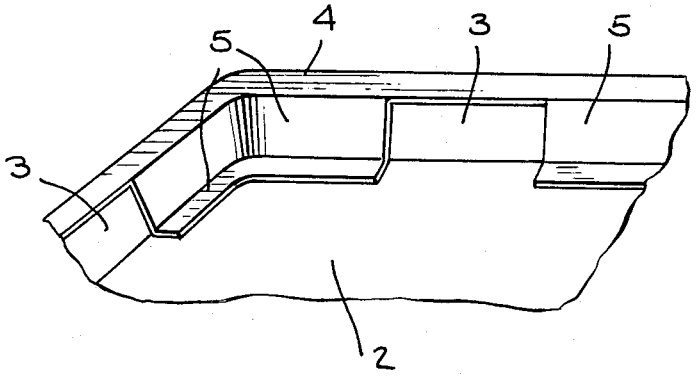

FIG. 3 is a cross-sectional view of part of an alternative embodiment of the package with a second lid, FIG. 4 is a view from the top of part of the package of FIG. 3 showing part of the tray rim before the lid is sealed on, FIG. 5 is a cross-sectional view of part of a second alternative embodiment of the package with the lid shown in FIG. 3 and FIG. 6 is a detailed view in perspective of a third alternative embodiment of the package without lid on.

In the Figures, the tray is made e.g. by press moulding in a PEERLESS machine or folding a material which is transparent to microwave radiation such as paperboard, or a paperboard coated with a plastic film. It may also be made by injection moulding or thermoforming of a plastic material, preferably a polyester, e.g., polybutylene or polypropylene terephthalate, a polyolefin e.g. polybutylene, polymethylpentene or polypropylene, or suitable combinations of such materials.

The tray comprises a bottom wall 2 and a peripheral wall 3 ending with a horizontally extending rim 4. The rim 4 is coated partly (FIG. 4) or totally (FIG. 5) with a material 5 reflecting or opaque to microwave radiation such as an aluminium foil. The peripheral wall 3 is coated with a foil of material 5 that may be arranged on different ways so as to act as a reflector of microwave radiation toward the centre of the tray. The wall 3 may thus be coated entirely (FIG. 1) of partly, e.g. around its corners (FIG. 6, cipher 5) with a material 5. The metallic foil may be laminated or sealed to the microwave radiation-transparent material or applied when forming the tray or after forming or folding of the tray.

The tray may be covered with an aluminium lid 6 as shown in FIG. 3. In this case, the lid is removed just before cooking e.g. by means of a conventional tear tab and easy opening, not represented.

FIGS. 3 and 4 show an alternative embodiment of the package, wherein the tray comprises paperboard walls 2 and 3 coated with a polymer sheet 7 on their inner surfaces, which is partly laminated with aluminium foil 5. Only part of the horizontal rim 4 is covered with aluminium, the outer part 8 being used as sealing area. The outer part 8 of the rim 4, where the aluminium foil 5 ends, is provided with a peripheric perforation line 9 so that the outer part of the rim is joined to the tray with small notches only. The tray is covered with a lid 6, which is made of a paperboard 10 coated with a polymer film 11. Alternatively, the lid may be of a polymer foil. The edge 12 of the lid 6 is heat-sealed to the outer part 8 of the rim 4. When opening before cooking, the outer part 8 of the rim 4 is teared away with the lid 6, the lid preferably being provided with a tear tab not shown in the drawings. This leaves a protective coating of material 5 on the whole horizontal rim 4. It is obvious that the perforation must have the exact design so that the opened tray has fairly clean edges and further that the tray is easy to open. The tray must also have a satisfactory tightness and strength.

FIG. 5 shows a second alternative embodiment of the package which differs from that of FIG. 3 in that the whole surface of the horizontal rim 4 is coated, e.g. laminated with an aluminium foil 5, the metallic part thereof being provided with a perforation line 9. In this case, the lid may be of paperboard coated with a polymer foil, e.g. of ionomer (SURLYN), which can be laminated with an aluminium foil.

Although the drawings show packages of rectangular shape, they could be of a square or circular shape. Also the outer surface of the peripheral edge may be covered with a metallic foil for preventing heat deterioration and giving a contribution to the strength of the paperboard.

Alternatively, the package may be entirely metallic e.g. formed from an aluminium foil, and have an easily removable bottom e.g. by means of an easy opening.

In this case, just before cooking, the lid is removed and the bottom torn off e.g. by means of a tear strip formed by weakened lines, and the package containing the food placed on a ceramic plate or tray for cooking. Of course, the principle of the invention can be applied to trays with multiple compartments. In this case the separation walls are in, or are coated with a microwave radiation reflecting material as indicated above.

Alternatively, the package may consist of a paperboard or paperboard/plastic bottom fixed, e.g. seamed to a peripheral wall formed as a frame of pure aluminium foil.

The package of the invention is preferably suitable for refrigerated foods as well as frozen foods.

Trials in a household oven at temperatures up to 300° C. have shown that the walls and rim are protected by the aluminium foil against visible browning and deterioration.

When cooking in a microwave oven a composite gratin product, comprising a vegetable layer at the bottom, fish fillets in the middle, a sauce on the top and mashed potatoes spread round the edge, from a frozen state (−25° C.) for 14 minutes followed by a 4 minutes browning with IR-grill (Sharp model R 8200E), in:

(1) the tray according to the invention
(2) a conventional aluminium tray and
(3) a polyester-coated paperboard tray, the following results were obtained:

(1) Even temperature distribution with slight variations from 65° to 80° C. Good product quality without overcooking and the product centre properly cooked. The quality is quite as good as after cooking in a conventional household oven.
(2) Bottom layer still cold with some remaining ice while the spot layer is overcooked with burnt spots. Temperature distribution 0° to 30° C.
(3) The corners are overcooked and somewhat burnt, while the middle parts of the fish fillets are still uncooked. Temperature distribution 20° to 100° C. The paperboard tray is almost black at the edges and deteriorated.

The above results show that the construction of the invention provides heating of the product from the top and the bottom and a relatively greater proportion of the radiation is directed to the central parts thanks to the metallic coating on the side walls. Also the metallic coating of the rim protects the paperboard part of the tray from being deteriorated.

The conventional trays, however, are totally unacceptable.

We claim:

1. A food package for controlled heating of prepared food in hot air, convection, household and microwave ovens, said package comprising a tray including a bottom wall transparent to microwave radiation and a peripheral structure, said peripheral structure including a peripheral wall extending upwardly from said bottom wall and a rim extending outwardly from said peripheral wall at the top thereof, at least a portion of said peripheral structure incorporating a microwave radiation reflecting material.

2. A food package for controlled heating of prepared food in hot air, convection, household and microwave ovens comprising a tray including a metallic bottom wall and a metallic peripheral structure, said peripheral structure including a peripheral wall extending upwardly from said bottom wall and a rim extending outwardly from said peripheral wall at the top thereof, said bottom wall being releasably connected to said peripheral wall.

3. A food package according to claim 1, in which the tray is formed from a polymer-coated paperboard, the peripheral wall of said tray being coated with a metallic foil on its inner surface, the rim of said tray being coated with said metallic foil on its upper surface.

4. A food package according to claim 3, in which the peripheral wall is partly coated with said metallic foil on its internal surface around each corner.

5. A food package according to claim 3 or 4 in which the coating of said foil on said rim extends over only an inner portion of said rim which is adjacent to said peripheral wall, the outer part of the rim which extends from the end of the metallic foil up to the edge of the rim being provided with a peripheric perforation line near to the end of the metallic foil, so that the outer part of the rim is joined to the tray with small notches only, said package further comprising a lid incorporating a polymer, the lid being attached to the outer part of the rim of the tray, said lid covering said tray.

6. A food package according to claim 3 or 4, in which the entire upper surface of said rim of the tray is coated with said metallic foil and said rim is provided in its middle with a perforation line, said package further comprising a lid incorporating a polymer, said lid being attached to the rim outboard of said perforation line, said lid covering said tray.

7. A food package according to claim 1 or 2, further comprising a metallic lid releasably secured to said tray, said lid covering said tray.

* * * * *